US011286537B2

(12) United States Patent
Oda et al.

(10) Patent No.: US 11,286,537 B2
(45) **Date of Patent: *Mar. 29, 2022**

(54) NON-ORIENTED ELECTRICAL STEEL SHEET AND METHOD OF PRODUCING SAME

(71) Applicant: JFE STEEL CORPORATION, Tokyo (JP)

(72) Inventors: Yoshihiko Oda, Tokyo (JP); Tomoyuki Okubo, Tokyo (JP); Yoshiaki Zaizen, Tokyo (JP); Masanori Uesaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 132 days.

This patent is subject to a terminal disclaimer.

(21) Appl. No.: 16/476,937

(22) PCT Filed: Jan. 12, 2018

(86) PCT No.: PCT/JP2018/000710
§ 371 (c)(1),
(2) Date: Jul. 10, 2019

(87) PCT Pub. No.: WO2018/135414
PCT Pub. Date: Jul. 26, 2018

(65) Prior Publication Data

US 2019/0330710 A1 Oct. 31, 2019

(30) Foreign Application Priority Data

Jan. 17, 2017 (JP) ..... JP2017-006205

(51) Int. Cl.
*C21D 9/46* (2006.01)
*C22C 38/14* (2006.01)
(Continued)

(52) U.S. Cl.
CPC ..... *C21D 9/46* (2013.01); *C21D 6/001* (2013.01); *C21D 6/005* (2013.01); *C21D 6/008* (2013.01);
(Continued)

(58) Field of Classification Search
CPC ... C21D 6/00; C21D 8/00; C21D 8/12; C21D 9/46; C22C 38/00; C22C 38/02;
(Continued)

(56) References Cited

U.S. PATENT DOCUMENTS 5,803,989 A 9/1998 Kawamata et al.
6,436,199 B1 8/2002 Hayakawa et al.
(Continued)

FOREIGN PATENT DOCUMENTS

CN 1047207 C 12/1999
CN 101084322 A 12/2007
(Continued)

OTHER PUBLICATIONS

The Metastable Iron Carbon (Fe—C) Phase Diagram Calphad (Year: 2007).*
(Continued)

*Primary Examiner* — Jenny R Wu
(74) *Attorney, Agent, or Firm* — Kenja IP Law PC

(57) ABSTRACT

According to the disclosure, it is possible to increase the magnetic flux density and reduce iron loss by setting a chemical composition containing, by mass %, C: 0.0050% or less, Si: 1.50% or more and 4.00% or less, Al: 0.500% or less, Mn: 0.10% or more and 5.00% or less, S: 0.0200% or less, P: 0.200% or less, N: 0.0050% or less, O: 0.0200% or less, and at least one of Sb: 0.0010% or more and 0.10% or less, and Sn: 0.0010% or more and 0.10% or less, with the balance being Fe and inevitable impurities, an $Ar_3$ transformation temperature of 700° C. or higher, a grain size of 80
(Continued)

μm or more and 200 μm or less, and a Vickers hardness of 140 HV or more and 230 HV or less.

16 Claims, 1 Drawing Sheet

(51) Int. Cl.

| | |
|---|---|
| ***C22C 38/12*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/12*** | (2006.01) |
| ***C21D 8/00*** | (2006.01) |
| ***C21D 6/00*** | (2006.01) |
| ***H01F 1/147*** | (2006.01) |
| ***C22C 38/08*** | (2006.01) |

(52) U.S. Cl.
CPC ..... *C21D 8/005* (2013.01); *C21D 8/1222* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *H01F 1/147* (2013.01); *C22C 2202/02* (2013.01)

(58) Field of Classification Search
CPC ..... C22C 38/04; C22C 38/06; C22C 38/08; C22C 38/12; C22C 38/14; H01F 1/147
See application file for complete search history.

(56) References Cited

U.S. PATENT DOCUMENTS

| | | | | |
|---|---|---|---|---|
| 6,503,339 | B1 | 1/2003 | Pircher et al. | |
| 7,501,028 | B2 | 3/2009 | Hammer et al. | |
| 7,846,271 | B2 | 12/2010 | Choi et al. | |
| 8,097,094 | B2 * | 1/2012 | Murakami | C22C 38/004 148/307 |
| 9,466,411 | B2 | 10/2016 | Oda et al. | |
| 9,728,312 | B2 | 8/2017 | Fujikura et al. | |
| 2002/0043299 | A1 | 4/2002 | Tanaka et al. | |
| 2004/0149355 | A1 | 8/2004 | Kohno et al. | |
| 2008/0121314 | A1 | 5/2008 | Choi et al. | |
| 2014/0238558 | A1 | 8/2014 | Fujikura et al. | |
| 2015/0318093 | A1 | 11/2015 | Hill et al. | |
| 2018/0001369 | A1 | 1/2018 | Senda et al. | |
| 2018/0202021 | A1 | 7/2018 | Oda et al. | |
| 2018/0355450 | A1 * | 12/2018 | Lee | C22C 38/02 |
| 2019/0244735 | A1 | 8/2019 | Oda et al. | |

FOREIGN PATENT DOCUMENTS

| | | | |
|---|---|---|---|
| CN | 103827333 | A | 5/2014 |
| EP | 1081238 | A2 | 3/2001 |
| JP | H10251752 | A | 9/1998 |
| JP | 2000129410 | A | 5/2000 |
| JP | 2001316729 | A | 11/2001 |
| JP | 2001323352 | A | 11/2001 |
| JP | 2002504624 | A | 2/2002 |
| JP | 2005525469 | A | 8/2005 |
| JP | 2013044009 | A | 3/2013 |
| JP | 2014195818 | A | 10/2014 |
| JP | 2014195818 | A * | 10/2014 |
| JP | 2016129902 | A | 7/2016 |
| KR | 1020140073569 | A | 6/2014 |
| KR | 1020140084896 | A | 7/2014 |
| KR | 1020160073222 | A | 6/2016 |
| WO | 9308313 | A1 | 4/1993 |
| WO | 2006068399 | A1 | 6/2006 |
| WO | 2016114212 | A1 | 7/2016 |
| WO | 2017056383 | A1 | 4/2017 |

OTHER PUBLICATIONS

Sep. 24, 2019, Notification of Reasons for Refusal issued by the Japan Patent Office in the corresponding Japanese Patent Application No. 2017-006205 with English language concise statement of relevance.
Sep. 4, 2020, Office Action issued by the China National Intellectual Property Administration in the corresponding Chinese Patent Application No. 201880007130.4 with English language search report.
Sep. 9, 2020, Office Action issued by the Korean Intellectual Property Office in the corresponding Korean Patent Application No. 10-2019-7019541 with English language concise statement of relevance.
Nov. 7, 2019, the Extended European Search Report issued by the European Patent Office in the corresponding European Patent Application No. 18741549.2.
Mar. 23, 2020, Office Action issued by the Taiwan Intellectual Property Office in the corresponding Taiwanese Patent Application No. 107101683 with English language search report.
Oct. 20, 2020, Office Action issued by the United States Patent and Trademark Office in the U.S. Appl. No. 16/343,847.
Apr. 16, 2019, Office Action issued by the Taiwanese Patent Office in the corresponding Taiwanese Patent Application No. 107101683 with English language Search Report.
Apr. 17, 2018, International Search Report issued in the International Patent Application No. PCT/JP2018/000710.
Oct. 24, 2018, Office Action issued by the Taiwanese Patent Office in the corresponding Taiwanese Patent Application No. 107101683 with English language Search Report.
Nov. 18, 2019, Office Action issued by the United States Patent and Trademark Office in the U.S. Appl. No. 15/743,776.
Feb. 21, 2020, Office Action issued by the United States Patent and Trademark Office in the U.S. Appl. No. 15/743,776.
May 27, 2020, Office Action issued by the United States Patent and Trademark Office in the U.S. Appl. No. 15/743,776.
Feb. 2, 2021, Office Action issued by the United States Patent and Trademark Office in the U.S. Appl. No. 16/343,847.
Calphad, The Metastable Iron-Carbon (Fe—C) Phase Diagram, 2007. Computational Thermodynamics Inc. (Year: 2007).

* cited by examiner

NON-ORIENTED ELECTRICAL STEEL SHEET AND METHOD OF PRODUCING SAME

TECHNICAL FIELD

This disclosure relates to a non-oriented electrical steel sheet and a method of producing the same.

BACKGROUND

Recently, high efficiency induction motors are being used to meet increasing energy saving needs in factories. To improve induction efficiency of such motors, attempts are being made to increase the thickness of an iron core lamination and improve the winding filling factor thereof. Further attempts are being made to replace a conventional low grade material with a higher grade material having low iron loss properties as an electrical steel sheet used for iron cores.

Additionally, from the viewpoint of reducing copper loss, such core materials for induction motors are required to have low iron loss properties and to lower the exciting effective current at the designed magnetic flux density. In order to reduce the exciting effective current, it is effective to increase the magnetic flux density of the core material.

Further, in the case of drive motors of hybrid electric vehicles, which have been rapidly spreading recently, high torque is required at the time of starting and accelerating, and thus further improvement of magnetic flux density is desired.

As an electrical steel sheet having a high magnetic flux density, for example, JP2000129410A (PTL 1) describes a non-oriented electrical steel sheet made of a steel to which Si is added at 4% or less and Co at 0.1% or more and 5% or less. However, since Co is very expensive, leading to the problem of a significant increase in cost when applied to a general motor.

On the other hand, use of a certain material with a low Si content makes it possible to increase the magnetic flux density. However, such a material is soft, and experiences a significant increase in iron loss when punched into a motor core material.

CITATION LIST

Patent Literature

PTL 1: JP2000129410A

SUMMARY

Technical Problem

Under these circumstances, there is a demand for a technique for increasing the magnetic flux density of an electrical steel sheet and reducing the iron loss without causing a significant increase in cost.

It would thus be helpful to provide a non-oriented electrical steel sheet with an increased magnetic flux density and reduced iron loss, and a method of producing the same.

Solution to Problem

As a result of extensive investigations on the solution of the above problems, we have found that by adjusting the chemical composition such that it allows for $\gamma \rightarrow \alpha$ transformation (transformation from $\gamma$ phase to $\alpha$ phase) during hot rolling and by setting the Vickers hardness to 140 HV or more and 230 HV or less, it is possible to obtain a material with an improved balance between its magnetic flux density and iron loss properties without performing hot band annealing.

The present disclosure was completed based on these findings, and the primary features thereof are as described below.

1. A non-oriented electrical steel sheet comprising a chemical composition containing (consisting of), by mass %, C: 0.0050% or less, Si: 1.50% or more and 4.00% or less, Al: 0.500% or less, Mn: 0.10% or more and 5.00% or less, S: 0.0200% or less, P: 0.200% or less, N: 0.0050% or less, O: 0.0200% or less, and at least one of Sb: 0.0010% or more and 0.10% or less or Sn: 0.0010% or more and 0.10% or less, with the balance being Fe and inevitable impurities, wherein the non-oriented electrical steel sheet has an $Ar_3$ transformation temperature of 700° C. or higher, a grain size of 80 μm or more and 200 μm or less, and a Vickers hardness of 140 HV or more and 230 HV or less.

2. The non-oriented electrical steel sheet according to 1., wherein the chemical composition further contains, by mass %, Ca: 0.0010% or more and 0.0050% or less.

3. The non-oriented electrical steel sheet according to 1. or 2., wherein the chemical composition further contains, by mass %, Ni: 0.010% or more and 3.0% or less.

4. The non-oriented electrical steel sheet according to any one of 1. to 3., wherein the chemical composition further contains, by mass %, at least one selected from the group consisting of Ti: 0.0030% or less, Nb: 0.0030% or less, V: 0.0030% or less, and Zr: 0.0020% or less.

5. A method of producing the non-oriented electrical steel sheet as recited in any one of 1. to 4., the method comprising performing hot rolling in at least one pass in a dual phase region from $\gamma$-phase to $\alpha$-phase.

Advantageous Effect

According to the disclosure, it is possible to obtain an electrical steel sheet with high magnetic flux density and low iron loss without performing hot band annealing.

DETAILED DESCRIPTION

The reasons for the limitations of the disclosure will be described below.

Firstly, in order to investigate the influence of the dual-phase region from $\gamma$-phase to $\alpha$-phase on the magnetic properties, Steel A to Steel C having the chemical compositions listed in Table 1 were prepared by steelmaking in a laboratory, and hot rolled. The hot rolling was performed in 7 passes, where the entry temperature in the first pass (F1) was adjusted to 1030° C. and the entry temperature in the final pass (F7) to 910° C.

TABLE 1

| Steel | Chemical composition (mass %) | | | | | | | | | | | | | | | |
|---|---|---|---|---|---|---|---|---|---|---|---|---|---|---|---|---|
| | C | Si | Al | Mn | P | S | N | O | Sn | Sb | Ni | Ca | Ti | V | Zr | Nb |
| A | 0.0013 | 1.40 | 0.400 | 0.20 | 0.010 | 0.0004 | 0.0018 | 0.0020 | 0.0500 | 0.0010 | 0.100 | 0.0010 | 0.0010 | 0.0010 | 0.0005 | 0.0005 |
| B | 0.0017 | 1.30 | 0.300 | 0.30 | 0.010 | 0.0007 | 0.0020 | 0.0020 | 0.0500 | 0.0010 | 0.100 | 0.0010 | 0.0010 | 0.0009 | 0.0004 | 0.0005 |
| C | 0.0015 | 2.00 | 0.001 | 0.80 | 0.010 | 0.0007 | 0.0023 | 0.0045 | 0.0500 | 0.0010 | 0.100 | 0.0010 | 0.0009 | 0.0010 | 0.0005 | 0.0003 |

After being pickled, each hot rolled sheet was cold rolled to a sheet thickness of 0.35 mm, and then subjected to final annealing at 950° C. for 10 seconds in a 20% $H_2$-80% $N_2$ atmosphere to obtain a final annealed sheet.

Figure 1:
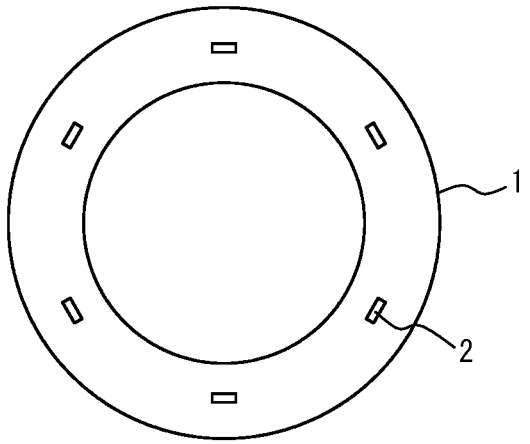
FIG. 1 is a schematic view of a caulking ring sample.

From each final annealed sheet thus obtained, a ring sample 1 having an outer diameter of 55 mm and an inner diameter of 35 mm was prepared by punching. Then, V caulking 2 was applied at six equally spaced positions of the ring sample 1 as illustrated in FIG. 1, and 10 ring samples 1 were stacked and fixed together into a stacked structure to measure the magnetic properties, the Vickers hardness, and the grain size. Magnetic property measurement was performed using the stacked structure thus obtained with windings of the first 100 turns and the second 100 turns, and the measurement results were evaluated using a wattmeter. The Vickers hardness was measured in accordance with JIS Z2244 by pressing a diamond indenter at 500 gf into a cross section of each steel sheet. Further, the grain size was measured in accordance with JIS G0551 after polishing the cross section and etching with nital.

The measurement results of the magnetic properties and Vickers hardness of Steel A to Steel C in Table 1 are listed in Table 2. Focusing attention on the magnetic flux density, it is understood that the magnetic flux density is low in Steel A and high in Steels B and C. In order to identify the cause, we investigated the texture of the material after final annealing, and revealed that the (111) texture which is disadvantageous to the magnetic properties was developed in Steel A as compared with Steels B and C. Since the microstructure of an electrical steel sheet before cold rolling is known to have a large influence on the texture formation in the electrical steel sheet, we made investigation on the microstructure after hot rolling prior to cold rolling, and found that Steel A had a non-recrystallized microstructure. For this reason, it is considered that in Steel A, a (111) texture was developed during the cold rolling and final annealing process after hot rolling.

TABLE 2

| Steel | Magnetic flux density $B_{50}$ (T) | Iron loss $W_{15/50}$ (W/kg) | HV | Grain size (μm) |
|---|---|---|---|---|
| A | 1.65 | 3.39 | 145 | 119 |
| B | 1.71 | 3.98 | 135 | 120 |
| C | 1.71 | 2.55 | 156 | 123 |

We also observed the microstructures of Steels B and C after subjection to the hot rolling, and found that the microstructures were completely recrystallized. It is thus considered that in Steels B and C, formation of a (111) texture disadvantageous to the improvement of the magnetic properties was suppressed and the magnetic flux density increased.

As described above, in order to identify the cause of varying microstructures after hot rolling among different steels, transformation behavior during hot rolling was evaluated by linear expansion coefficient measurement.

As a result, it was revealed that Steel A has a single α-phase from the high temperature range to the low temperature range, and that no phase transformation occurred during the hot rolling. On the other hand, it was revealed that the $Ar_3$ transformation temperature was 1020° C. for Steel B and 930° C. for Steel C, and that γ→α transformation occurred in the first pass in Steel B and in the third to fifth passes in Steel C. That is, it is considered that the difference in microstructures between steels after hot rolling is ascribable to the occurrence of γ→α transformation during the hot rolling causing the recrystallization to proceed in the steel sheet with the transformation strain as the driving force.

From the above, in order to obtain increased magnetic flux density, we found it important to have γ→α transformation in the temperature range where hot rolling is performed. Therefore, the following experiment was conducted to identify the $Ar_3$ transformation temperature at which γ→α transformation should be completed. Specifically, steels, each containing, by mass %, C: 0.0016%, Al: 0.001%, P: 0.010%, S: 0.0008%, N: 0.0020%, O: 0.0050% to 0.0070%, Sb: 0.0050%, Sn: 0.0050%, Ni: 0.100%, Ca: 0.0010%, Ti: 0.0010%, V: 0.0010%, Zr: 0.0005%, and Nb: 0.0004% as basic components, with the balance between the Si and Mn contents changed to alter the $Ar_3$ transformation temperatures, were prepared by steelmaking in a laboratory and formed into slabs. The slabs thus obtained were hot rolled. The hot rolling was performed in 7 passes, where the entry temperature in the first pass (F1) was adjusted to 900° C. and the entry temperature in the final pass (F7) to 780° C., such that at least one pass of the hot rolling was performed in a dual phase region in which transformation from α-phase to γ-phase would occur.

Each hot rolled sheet thus prepared was pickled, and then cold rolled to a sheet thickness of 0.35 mm, and final annealed at 950° C. for 10 seconds in a 20% $H_2$-80% $N_2$ atmosphere to obtain a final annealed sheet.

From each final annealed sheet thus obtained, a ring sample 1 having an outer diameter of 55 mm and an inner diameter of 35 mm was prepared by punching, V caulking 2 was applied at six equally spaced positions of the ring sample 1 as illustrated in FIG. 1, and 10 ring samples 1 were stacked and fixed together into a stacked structure. Magnetic property measurement was performed using the stacked structure with windings of the first 100 turns and the second 100 turns, and the measurement results were evaluated using a wattmeter.

Figure 2:
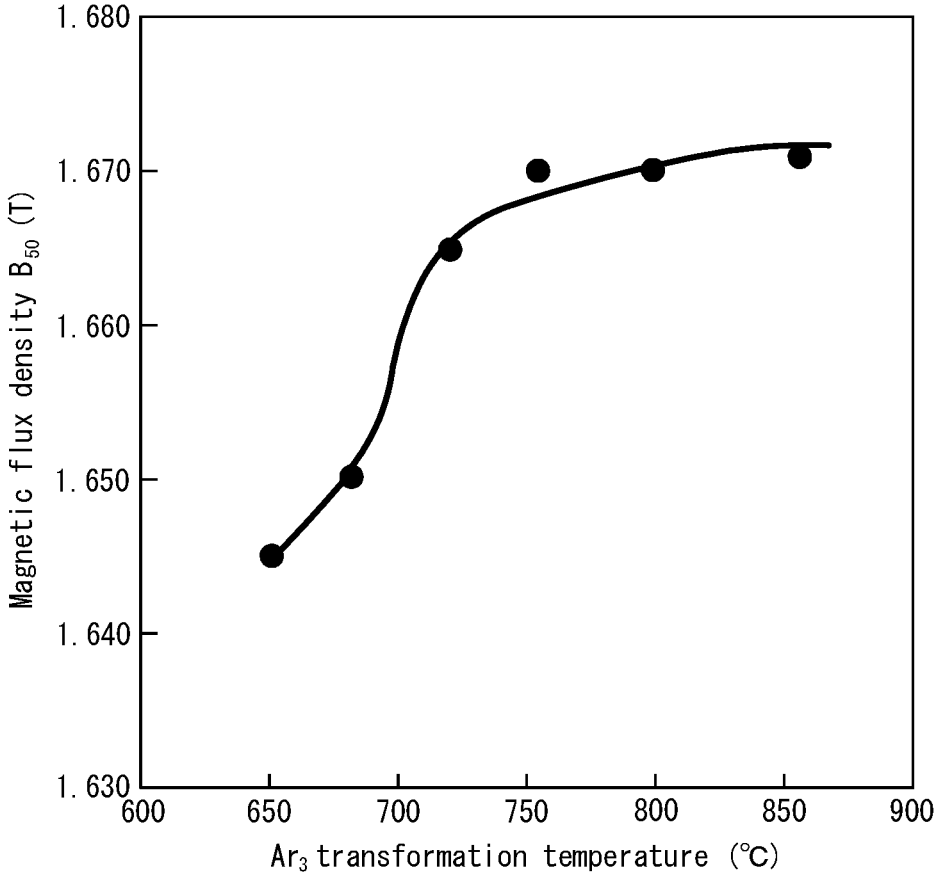
FIG. 2 is a graph illustrating the influence of $Ar_3$ transformation temperature on magnetic flux density $B_{50}$.

FIG. 2 illustrates the influence of the $Ar_3$ transformation temperature on the magnetic flux density $B_{50}$. It can be seen that when the $Ar_3$ transformation temperature is below 700° C., the magnetic flux density $B_{50}$ decreases. Although the reason is not clear, it is considered to be that when the $Ar_3$ transformation temperature was below 700° C., the grain size before cold rolling was so small that it caused a (111) texture disadvantageous to the magnetic properties to develop during the process from the subsequent cold rolling to final annealing.

From the above, in the present disclosure, the $Ar_3$ transformation temperature is set to 700° C. or higher. No upper limit is placed on the $Ar_3$ transformation temperature. However, it is important that $\gamma \rightarrow \alpha$ transformation is caused to occur during hot rolling, and at least one pass of the hot rolling needs to be performed in a dual phase region of γ-phase and α-phase. In view of this, it is preferable that the $Ar_3$ transformation temperature is set to 1000° C. or lower. This is because performing hot rolling during transformation promotes development of a texture which is preferable for the magnetic properties.

Focusing on the evaluation of iron loss in Table 2 above, it can be seen that iron loss is low in Steels A and C and high in Steel B. Although the cause is not clear, it is considered to be that since the hardness (HV) of the steel sheet after final annealing was low in Steel B, a compressive stress field generated by punching and caulking was spread easily and iron loss increased. Therefore, in the present disclosure, the Vickers hardness is set to 140 HV or more, and preferably 150 HV or more. On the other hand, a Vickers hardness above 230 HV wears the punching mold more severely, which unnecessarily increases the cost. Thus, the upper limit is set at 230 HV. From the viewpoint of suppressing mold wear, it is preferably set to 200 HV or less.

The following describes a non-oriented electrical steel sheet according to one of the disclosed embodiments. Firstly, the reasons for limitations on the chemical composition of steel will be explained. When components are expressed in "%", this refers to "mass %" unless otherwise specified.

C: 0.0050% or Less

C content is set to 0.0050% or less from the viewpoint of preventing magnetic aging. On the other hand, since C has an effect of improving the magnetic flux density, the C content is preferably 0.0010% or more.

Si: 1.50% or More and 4.00% or Less

Si is a useful element for increasing the specific resistance of a steel sheet. Thus, the Si content is preferably set to 1.50% or more. On the other hand, Si content exceeding 4.00% results in a decrease in saturation magnetic flux density and an associated decrease in magnetic flux density. Thus, the upper limit for the Si content is set at 4.00%. The Si content is preferably 3.00% or less. This is because, if the Si content exceeds 3.00%, it is necessary to add a large amount of Mn in order to obtain a dual phase region, which unnecessarily increases the cost.

Al: 0.500% or Less

Al is an element which narrows the temperature range in which the γ phase appears, and a lower Al content is preferable. The Al content is set to 0.500% or less. Note that the Al content is preferably 0.020% or less, and more preferably 0.002% or less. On the other hand, the Al content is preferably 0.0005% or more from the viewpoint of production cost and the like.

Mn: 0.10% or More and 5.00% or Less

Since Mn is an effective element for expanding the temperature range in which the γ phase appears, the lower limit is set at 0.10%. On the other hand, Mn content exceeding 5.00% results in a decrease in magnetic flux density. Thus, the upper limit for the Mn content is set at 5.00%. The Mn content is preferably 3.00% or less. The reason is that Mn content exceeding 3.00% unnecessarily increases the cost.

S: 0.0200% or Less

S causes an increase in iron loss due to precipitation of MnS if added beyond 0.0200%. Thus, the upper limit for the S content is set at 0.0200%. On the other hand, the S content is preferably 0.0005% or more from the viewpoint of production cost and the like.

P: 0.200% or Less

P increases the hardness of the steel sheet if added beyond 0.200%. Thus, the P content is set to 0.200% or less, and more preferably 0.100% or less. Further preferably, the P content is set to 0.010% or more and 0.050% or less. This is because P has the effect of suppressing nitridation by surface segregation.

N: 0.0050% or Less

N causes more AlN precipitation and increases iron loss if added in a large amount. Therefore, the N content is set to 0.0050% or less. On the other hand, the N content is preferably 0.0005% or more from the viewpoint of production cost and the like.

O: 0.0200% or Less

O causes more oxides and increases iron loss if added in a large amount. Therefore, the O content is set to 0.0200% or less. On the other hand, the O content is preferably 0.0010% or more from the viewpoint of production cost and the like.

At Least One of Sb: 0.0010% or More and 0.10% or Less or Sn: 0.0010% or More and 0.10% or Less Sb and Sn are effective elements for improving the texture structure, and the lower limit of each is set at 0.0010%. In particular, when the Al content is 0.010% or less, the effect of improving the magnetic flux density by adding Sb and Sn is large, and the addition of 0.050% or more greatly improves the magnetic flux density. On the other hand, the addition beyond 0.10% ends up in unnecessarily increased costs since the effect attained by the addition reaches a plateau. Thus, the upper limit of each is set at 0.10%.

The basic components of the steel sheet according to the disclosure have been described. The balance other than the above components consists of Fe and inevitable impurities. However, the following optional elements may also be added as appropriate.

Ca: 0.0010% or More and 0.0050% or Less.

Ca can fix sulfides as CaS and reduce iron loss. Therefore, when Ca is added, the lower limit for the Ca content is preferably set at 0.0010%. On the other hand, if the Ca content exceeds 0.0050%, a large amount of CaS is precipitated and the iron loss increases. Thus, the upper limit for the Ca content is set at 0.0050%. In order to stably reduce the iron loss, the Ca content is more preferably set to 0.0015% or more and 0.0035% or less.

Ni: 0.010% or More and 3.0% or Less

Since Ni is an effective element for enlarging the γ region, when Ni is added, the lower limit for the Ni content is preferably set at 0.010%. On the other hand, Ni content exceeding 3.0% unnecessarily increases the cost. Therefore, it is preferable to set the upper limit for the Ni content at 3.0%, and it is more preferable to set the Ni content in the range of 0.100% to 1.0%.

Ti: 0.0030% or Less

Ti may cause more TiN precipitation and increase iron loss if added in a large amount. Therefore, when Ti is added, the Ti content is set to 0.0030% or less. On the other hand, the Ti content is preferably 0.0001% or more from the viewpoint of production cost and the like.

Nb: 0.0030% or Less

Nb may cause more NbC precipitation and increase iron loss if added in a large amount. Therefore, when Nb is added, the Nb content is set to 0.0030% or less. On the other hand, the Nb content is preferably 0.0001% or more from the viewpoint of production cost and the like.

V: 0.0030% or Less

V may cause more VN and VC precipitation and increase iron loss if added in a large amount. Therefore, when V is added, the V content is set to 0.0030% or less. On the other hand, the V content is preferably 0.0005% or more from the viewpoint of production cost and the like.

Zr: 0.0020% or Less

Zr may cause more ZrN precipitation and increase iron loss if added in a large amount. Therefore, when Zr is added, the Zr content is set to 0.0020% or less. On the other hand, the Zr content is preferably 0.0005% or more from the viewpoint of production cost and the like.

The average grain size of the steel sheet disclosed herein is set to 80 μm or more and 200 μm or less. When the average grain size is less than 80 μm, the Vickers hardness can be adjusted to 140 HV or more with a low-Si material, in which case, however, the iron loss would increase. Therefore, the grain size is set to 80 μm or more. On the other hand, when the grain size exceeds 200 μm, plastic deformation due to punching and caulking increases, resulting in increased iron loss. Thus, the upper limit for the grain size is set at 200 μm.

To obtain a grain size of 80 μm or more and 200 μm or less, it is necessary to appropriately control the final annealing temperature. In addition, to provide a Vickers hardness of 140 HV or more and 230 HV or less, it is necessary to appropriately add a solid-solution-strengthening element such as Si, Mn, or P.

The following provides a specific description of the conditions for producing the non-oriented electrical steel sheet according to the disclosure.

The non-oriented electrical steel sheet disclosed herein may be produced otherwise following a conventional method of producing a non-oriented electrical steel sheet as long as the chemical composition and the hot rolling conditions are within the ranges specified herein. That is, molten steel is subjected to blowing in the converter and degassing treatment where it is adjusted to a predetermined chemical composition, and subsequently to casting and hot rolling. The coiling temperature during hot rolling is not particularly specified, yet it is necessary to perform at least one pass of the hot rolling in a dual phase region of γ-phase and α-phase. The coiling temperature is preferably set to 650° C. or lower in order to prevent oxidation during coiling. In addition, the final annealing temperature is preferably set to a range satisfying the grain size of the steel sheet, for example, in the range of 900° C. to 1050° C. According to the present disclosure, excellent magnetic properties can be obtained without hot band annealing. However, hot band annealing may be carried out. Then, the steel sheet is subjected to cold rolling once, or twice or more with intermediate annealing performed therebetween, to a predetermined sheet thickness, and to the subsequent final annealing.

EXAMPLES

Molten steels were subjected to blowing in the converter and degassing treatment where they were adjusted to the chemical compositions as listed in Tables 3-1 and 3-2, then to slab heating at 1120° C. for 1 hour, and subsequently to hot rolling to a thickness of 2.0 mm. The hot finish rolling was performed in 7 passes, the entry temperatures of the first pass and the final pass were respectively set as listed in Tables 3-1 and 3-2, and the coiling temperature was set to 650° C. Then, pickling was carried out, cold rolling was performed to a thickness of 0.35 mm, and final annealing was performed with a 20% $H_2$-80% $N_2$ atmosphere for an annealing time of 10 seconds under the conditions listed in Tables 3-1 and 3-2, to prepare test specimens. For each test specimen, the magnetic properties ($W_{15/50}$, $B_{50}$), Vickers hardness (HV), and grain size (μm) were evaluated. Measurement of magnetic properties was carried out in accordance with Epstein measurement on Epstein samples cut out from the rolling direction and the transverse direction (direction orthogonal to the rolling direction). Vickers hardness was measured in accordance with JIS Z2244 by pressing a diamond indenter at a load of 500 gf into a cross section of each steel sheet. The grain size was measured in accordance with JIS G0551 after polishing the cross section and etching with nital.

TABLE 3-1

| | Chemical composition (mass %) | | | | | | | | | | | | | | | |
|---|---|---|---|---|---|---|---|---|---|---|---|---|---|---|---|---|
| No. | C | Si | Mn | P | S | Al | Sb | Sn | Ca | Ni | Ti | V | Zr | Nb | O | N |
| 1 | 0.0016 | 1.45 | 0.15 | 0.020 | 0.0019 | 0.500 | 0.0001 | 0.0200 | 0.0020 | 0.020 | 0.0002 | 0.0007 | 0.0001 | 0.0002 | 0.0012 | 0.0012 |
| 2 | 0.0019 | 1.29 | 0.18 | 0.031 | 0.0018 | 0.020 | 0.0001 | 0.0200 | 0.0020 | 0.020 | 0.0002 | 0.0007 | 0.0001 | 0.0002 | 0.0013 | 0.0015 |
| 3 | 0.0020 | 3.00 | 0.30 | 0.010 | 0.0020 | 0.010 | 0.0010 | 0.0100 | 0.0020 | 0.010 | 0.0010 | 0.0005 | 0.0001 | 0.0002 | 0.0010 | 0.0010 |
| 4 | 0.0014 | 1.65 | 0.25 | 0.045 | 0.0025 | 0.001 | 0.0001 | 0.0001 | 0.0020 | 0.200 | 0.0015 | 0.0006 | 0.0001 | 0.0002 | 0.0030 | 0.0016 |
| 5 | 0.0014 | 1.65 | 0.25 | 0.045 | 0.0013 | 0.001 | 0.0001 | 0.0200 | 0.0020 | 0.200 | 0.0002 | 0.0006 | 0.0001 | 0.0002 | 0.0030 | 0.0016 |
| 6 | 0.0015 | 1.54 | 0.30 | 0.045 | 0.0013 | 0.001 | 0.0001 | 0.0200 | 0.0020 | 0.400 | 0.0002 | 0.0007 | 0.0001 | 0.0002 | 0.0030 | 0.0017 |
| 7 | 0.0016 | 1.81 | 0.51 | 0.020 | 0.0013 | 0.001 | 0.0001 | 0.0200 | 0.0020 | 0.150 | 0.0002 | 0.0007 | 0.0001 | 0.0002 | 0.0030 | 0.0020 |
| 8 | 0.0016 | 1.81 | 0.50 | 0.020 | 0.0013 | 0.002 | 0.0001 | 0.0200 | 0.0020 | 0.150 | 0.0002 | 0.0007 | 0.0001 | 0.0002 | 0.0030 | 0.0021 |
| 9 | 0.0020 | 1.81 | 0.50 | 0.020 | 0.0013 | 0.004 | 0.0001 | 0.0200 | 0.0020 | 0.150 | 0.0002 | 0.0006 | 0.0001 | 0.0002 | 0.0030 | 0.0019 |
| 10 | 0.0019 | 1.29 | 0.30 | 0.030 | 0.0013 | 0.001 | 0.0001 | 0.0200 | 0.0020 | 0.300 | 0.0002 | 0.0007 | 0.0001 | 0.0002 | 0.0030 | 0.0018 |
| 11 | 0.0019 | 1.42 | 0.30 | 0.030 | 0.0013 | 0.001 | 0.0001 | 0.0200 | 0.0020 | 0.300 | 0.0002 | 0.0007 | 0.0001 | 0.0002 | 0.0030 | 0.0017 |
| 12 | 0.0018 | 2.01 | 0.80 | 0.010 | 0.0013 | 0.001 | 0.0001 | 0.0200 | 0.0020 | 0.300 | 0.0002 | 0.0006 | 0.0001 | 0.0002 | 0.0030 | 0.0022 |
| 13 | 0.0016 | 2.51 | 1.20 | 0.010 | 0.0017 | 0.001 | 0.0001 | 0.0200 | 0.0020 | 0.300 | 0.0002 | 0.0007 | 0.0001 | 0.0002 | 0.0030 | 0.0020 |
| 14 | 0.0019 | 3.13 | 1.60 | 0.010 | 0.0016 | 0.001 | 0.0001 | 0.0200 | 0.0020 | 0.300 | 0.0002 | 0.0007 | 0.0001 | 0.0002 | 0.0030 | 0.0016 |
| 15 | 0.0016 | 2.05 | 2.00 | 0.010 | 0.0015 | 0.001 | 0.0001 | 0.0200 | 0.0020 | 0.300 | 0.0002 | 0.0006 | 0.0001 | 0.0002 | 0.0030 | 0.0022 |
| 16 | 0.0020 | 2.01 | 3.00 | 0.010 | 0.0016 | 0.001 | 0.0001 | 0.0200 | 0.0020 | 0.020 | 0.0010 | 0.0007 | 0.0001 | 0.0003 | 0.0030 | 0.0020 |
| 17 | 0.0017 | 4.61 | 3.00 | 0.010 | 0.0014 | 0.001 | 0.0001 | 0.0200 | 0.0020 | 0.020 | 0.0003 | 0.0007 | 0.0001 | 0.0002 | 0.0030 | 0.0021 |
| 18 | 0.0015 | 2.03 | 3.50 | 0.010 | 0.0012 | 0.001 | 0.0001 | 0.0200 | 0.0020 | 0.020 | 0.0010 | 0.0007 | 0.0001 | 0.0003 | 0.0030 | 0.0017 |
| 19 | 0.0014 | 2.51 | 5.60 | 0.032 | 0.0014 | 0.500 | 0.0001 | 0.0700 | 0.0020 | 0.020 | 0.0005 | 0.0006 | 0.0001 | 0.0005 | 0.0013 | 0.0019 |
| 20 | 0.0013 | 1.56 | 0.95 | 0.032 | 0.0018 | 0.300 | 0.0001 | 0.0700 | 0.0020 | 0.020 | 0.0005 | 0.0007 | 0.0001 | 0.0002 | 0.0010 | 0.0018 |
| 21 | 0.0016 | 1.70 | 0.95 | 0.032 | 0.0015 | 0.600 | 0.0001 | 0.0700 | 0.0020 | 0.020 | 0.0005 | 0.0007 | 0.0001 | 0.0002 | 0.0009 | 0.0015 |
| 22 | 0.0017 | 1.71 | 0.30 | 0.032 | 0.0015 | 0.001 | 0.0001 | 0.0200 | 0.0020 | 0.020 | 0.0005 | 0.0007 | 0.0001 | 0.0002 | 0.0030 | 0.0015 |
| 23 | 0.0017 | 1.72 | 0.30 | 0.032 | 0.0015 | 0.001 | 0.0001 | 0.0200 | 0.0020 | 0.020 | 0.0005 | 0.0007 | 0.0001 | 0.0002 | 0.0032 | 0.0016 |
| 24 | 0.0017 | 1.73 | 0.30 | 0.102 | 0.0016 | 0.001 | 0.0001 | 0.0200 | 0.0020 | 0.020 | 0.0005 | 0.0007 | 0.0001 | 0.0002 | 0.0035 | 0.0015 |
| 25 | 0.0017 | 1.82 | 0.82 | 0.252 | 0.0015 | 0.001 | 0.0001 | 0.0200 | 0.0020 | 0.020 | 0.0020 | 0.0007 | 0.0001 | 0.0002 | 0.0031 | 0.0022 |

TABLE 3-1-continued

| No. | $Ar_1$ (° C.) | $Ar_3$ (° C.) | Entry temp. in F1 (° C.) | Entry temp. in F7 (° C.) | Stand with dual phase | Sheet thickness (mm) | Final annealing temp. (° C.) | Grain size (μm) | HV | $W_{15/50}$ (W/kg) | $B_{50}$ (T) | Remarks |
|---|---|---|---|---|---|---|---|---|---|---|---|---|
| 1 | — | — | 1030 | 910 | — | 0.35 | 950 | 122 | 146 | 340 | 1.65 | Comparative steel |
| 2 | 1080 | 1020 | 1030 | 910 | F1 | 0.35 | 950 | 119 | 132 | 4.01 | 1.70 | Comparative steel |
| 3 | — | — | 1030 | 910 | — | 0.35 | 950 | 122 | 215 | 2.50 | 1.63 | Comparative steel |
| 4 | 1010 | 950 | 1030 | 910 | F3, F4, F5 | 0.35 | 950 | 120 | 152 | 3.05 | 1.67 | Comparative steel |
| 5 | 1010 | 950 | 1030 | 910 | F3, F4, F5 | 0.35 | 950 | 120 | 152 | 2.80 | 1.70 | Example steel |
| 6 | 1010 | 950 | 1030 | 910 | F3, F4, F5 | 0.35 | 950 | 120 | 143 | 2.81 | 1.70 | Example steel |
| 7 | 990 | 930 | 980 | 860 | F1, F2, F3 | 0.35 | 950 | 120 | 156 | 2.78 | 1.70 | Example steel |
| 8 | 1001 | 941 | 980 | 860 | F1, F2, F3 | 0.35 | 950 | 120 | 156 | 2.81 | 1.69 | Example steel |
| 9 | 1001 | 941 | 980 | 860 | F1, F2, F3 | 0.35 | 950 | 116 | 156 | 2.82 | 1.69 | Example steel |
| 10 | 990 | 930 | 980 | 860 | F1, F2, F3 | 0.35 | 950 | 120 | 135 | 3.85 | 1.72 | Comparative steel |
| 11 | 1000 | 940 | 980 | 860 | F1, F2, F3 | 0.35 | 890 | 69 | 150 | 4.20 | 1.72 | Comparative steel |
| 12 | 980 | 920 | 980 | 860 | F1, F2, F3 | 0.35 | 950 | 122 | 165 | 2.60 | 1.69 | Example steel |
| 13 | 970 | 910 | 980 | 860 | F2, F3, F4 | 0.35 | 1000 | 141 | 190 | 2.40 | 1.68 | Example steel |
| 14 | 970 | 910 | 980 | 860 | F2, F3, F4 | 0.35 | 1020 | 152 | 221 | 2.35 | 1.67 | Example steel |
| 15 | 880 | 820 | 980 | 860 | F5, F6, F7 | 0.35 | 1000 | 140 | 170 | 2.56 | 1.69 | Example steel |
| 16 | 790 | 730 | 870 | 750 | F6, F7 | 0.35 | 1000 | 140 | 176 | 2.80 | 1.65 | Example steel |
| 17 | 920 | 860 | 980 | 860 | F5, F6, F7 | 0.35 | 1020 | 141 | 285 | 2.52 | 1.61 | Comparative steel |
| 18 | 740 | 680 | 850 | 730 | F5 | 0.35 | 1000 | 142 | 175 | 3.05 | 1.64 | Comparative steel |
| 19 | 780 | 720 | 850 | 730 | F4, F5 | 0.35 | 1000 | 120 | 171 | 3.06 | 1.62 | Comparative steel |
| 20 | 1060 | 1000 | 1030 | 910 | F1, F2 | 0.35 | 950 | 122 | 151 | 2.80 | 1.68 | Example steel |
| 21 | — | — | 980 | 860 | — | 0.35 | 950 | 119 | 157 | 3.20 | 1.64 | Comparative steel |
| 22 | 1010 | 950 | 980 | 860 | F1, F2 | 0.35 | 870 | 52 | 165 | 3.95 | 1.70 | Comparative steel |
| 23 | 1010 | 950 | 980 | 860 | F1, F2 | 0.35 | 1100 | 210 | 135 | 3.65 | 1.66 | Comparative steel |
| 24 | 1020 | 960 | 980 | 860 | F1 | 0.35 | 950 | 120 | 166 | 2.80 | 1.72 | Example steel |
| 25 | 1020 | 960 | 990 | 870 | F1 | — | — | — | — | — | — | Fracture occurred during cold rolling |

TABLE 3-2

| No. | Chemical composition (mass %) | | | | | | | | | | | | | | | |
|---|---|---|---|---|---|---|---|---|---|---|---|---|---|---|---|---|
| | C | Si | Mn | P | S | Al | Sb | Sn | Ca | Ni | Ti | V | Zr | Nb | O | N |
| 26 | 0.0016 | 2.05 | 0.82 | 0.020 | 0.0014 | 0.002 | 0.0001 | 0.0600 | 0.0035 | 0.020 | 0.0005 | 0.0007 | 0.0001 | 0.0002 | 0.0032 | 0.0021 |
| 27 | 0.0015 | 2.05 | 0.82 | 0.021 | 0.0014 | 0.002 | 0.0001 | 0.0600 | 0.0045 | 0.020 | 0.0005 | 0.0007 | 0.0001 | 0.0002 | 0.0033 | 0.0022 |
| 28 | 0.0017 | 2.02 | 0.82 | 0.021 | 0.0016 | 0.002 | 0.0001 | 0.0600 | 0.0061 | 0.020 | 0.0005 | 0.0007 | 0.0001 | 0.0002 | 0.0032 | 0.0022 |
| 29 | 0.0016 | 2.05 | 0.82 | 0.021 | 0.0014 | 0.002 | 0.0001 | 0.0200 | 0.0035 | 0.005 | 0.0005 | 0.0006 | 0.0001 | 0.0002 | 0.0032 | 0.0021 |
| 30 | 0.0016 | 2.05 | 0.82 | 0.021 | 0.0015 | 0.002 | 0.0001 | 0.0200 | 0.0035 | 0.200 | 0.0005 | 0.0007 | 0.0001 | 0.0002 | 0.0032 | 0.0021 |
| 31 | 0.0016 | 2.05 | 0.82 | 0.021 | 0.0013 | 0.002 | 0.0001 | 0.0200 | 0.0035 | 1.000 | 0.0005 | 0.0007 | 0.0001 | 0.0002 | 0.0032 | 0.0021 |
| 32 | 0.0016 | 2.05 | 0.82 | 0.021 | 0.0015 | 0.002 | 0.0001 | 0.0200 | 0.0035 | 1600 | 0.0005 | 0.0007 | 0.0001 | 0.0002 | 0.0032 | 0.0021 |
| 33 | 0.0015 | 2.30 | 0.51 | 0.052 | 0.0015 | 0.001 | 0.0001 | 0.0600 | 0.0020 | 0.500 | 0.0025 | 0.0007 | 0.0001 | 0.0002 | 0.0032 | 0.0022 |
| 34 | 0.0015 | 2.32 | 0.52 | 0.052 | 0.0015 | 0.001 | 0.0001 | 0.0600 | 0.0020 | 0.500 | 0.0041 | 0.0007 | 0.0001 | 0.0002 | 0.0032 | 0.0022 |
| 35 | 0.0016 | 2.35 | 0.50 | 0.052 | 0.0015 | 0.001 | 0.0001 | 0.0600 | 0.0020 | 0.500 | 0.0006 | 0.0022 | 0.0001 | 0.0003 | 0.0031 | 0.0020 |
| 36 | 0.0013 | 2.35 | 0.52 | 0.052 | 0.0014 | 0.001 | 0.0001 | 0.0600 | 0.0020 | 0.500 | 0.0006 | 0.0038 | 0.0001 | 0.0003 | 0.0034 | 0.0021 |
| 37 | 0.0017 | 2.35 | 0.51 | 0.052 | 0.0016 | 0.001 | 0.0600 | 0.0700 | 0.0020 | 0.500 | 0.0005 | 0.0006 | 0.0010 | 0.0002 | 0.0033 | 0.0023 |
| 38 | 0.0017 | 2.36 | 0.49 | 0.052 | 0.0013 | 0.001 | 0.0600 | 0.0700 | 0.0020 | 0.500 | 0.0004 | 0.0006 | 0.0029 | 0.0003 | 0.0032 | 0.0024 |
| 39 | 0.0017 | 2.40 | 0.48 | 0.052 | 0.0009 | 0.001 | 0.0001 | 0.0500 | 0.0020 | 0.500 | 0.0003 | 0.0006 | 0.0001 | 0.0015 | 0.0036 | 0.0018 |
| 40 | 0.0012 | 2.30 | 0.45 | 0.052 | 0.0013 | 0.001 | 0.0001 | 0.0500 | 0.0020 | 0.500 | 0.0006 | 0.0006 | 0.0001 | 0.0039 | 0.0031 | 0.0019 |
| 41 | 0.0017 | 2.01 | 0.49 | 0.052 | 0.0010 | 0.001 | 0.0001 | 0.0200 | 0.0020 | 0.500 | 0.0006 | 0.0006 | 0.0001 | 0.0003 | 0.0262 | 0.0021 |
| 42 | 0.0017 | 2.01 | 0.43 | 0.052 | 0.0015 | 0.001 | 0.0001 | 0.0200 | 0.0020 | 0.500 | 0.0006 | 0.0006 | 0.0001 | 0.0003 | 0.0031 | 0.0061 |
| 43 | 0.0065 | 2.01 | 0.45 | 0.052 | 0.0015 | 0.001 | 0.0001 | 0.0200 | 0.0020 | 0.500 | 0.0006 | 0.0006 | 0.0001 | 0.0003 | 0.0032 | 0.0018 |
| 44 | 0.0016 | 2.02 | 0.44 | 0.052 | 0.2650 | 0.001 | 0.0001 | 0.0200 | 0.0020 | 0.500 | 0.0006 | 0.0006 | 0.0001 | 0.0003 | 0.0030 | 0.0019 |
| 45 | 0.0017 | 2.02 | 0.04 | 0.052 | 0.0021 | 0.001 | 0.0001 | 0.0200 | 0.0020 | 0.500 | 0.0005 | 0.0006 | 0.0001 | 0.0002 | 0.0031 | 0.0018 |
| 46 | 0.0012 | 1.65 | 0.25 | 0.042 | 0.0012 | 0.001 | 0.0030 | 0.0001 | 0.0020 | 0.020 | 0.0002 | 0.0006 | 0.0001 | 0.0002 | 0.0025 | 0.0015 |
| 47 | 0.0015 | 1.65 | 0.25 | 0.050 | 0.0010 | 0.001 | 0.0500 | 0.0001 | 0.0020 | 0.020 | 0.0002 | 0.0006 | 0.0001 | 0.0002 | 0.0024 | 0.0017 |
| 48 | 0.0016 | 1.65 | 0.25 | 0.051 | 0.0010 | 0.001 | 0.0001 | 0.0100 | 0.0020 | 0.020 | 0.0002 | 0.0006 | 0.0001 | 0.0002 | 0.0023 | 0.0014 |
| 49 | 0.0018 | 1.65 | 0.25 | 0.048 | 0.0009 | 0.001 | 0.0001 | 0.0600 | 0.0020 | 0.020 | 0.0002 | 0.0006 | 0.0001 | 0.0002 | 0.0021 | 0.0018 |

TABLE 3-2-continued

| | | | | | | | | | | | | | | | | |
|---|---|---|---|---|---|---|---|---|---|---|---|---|---|---|---|---|
| 50 | 0.0016 | 1.65 | 0.25 | 0.045 | 0.0008 | 0.001 | 0.0001 | 0.0900 | 0.0020 | 0.020 | 0.0002 | 0.0006 | 0.0001 | 0.0002 | 0.0026 | 0.0017 |
| 51 | 0.0018 | 1.65 | 0.25 | 0.048 | 0.0009 | 0.001 | 0.0300 | 0.0500 | 0.0020 | 0.020 | 0.0002 | 0.0006 | 0.0001 | 0.0002 | 0.0030 | 0.0015 |

| No. | $Ar_1$ (° C.) | $Ar_3$ (° C.) | Entry temp. in F1 (° C.) | Entry temp. in F7 (° C.) | Stand with dual phase | Sheet thickness (mm) | Final annealing temp. (° C.) | Grain size (μm) | HV | $W_{15/50}$ (W/kg) | $B_{50}$ (T) | Remarks |
|---|---|---|---|---|---|---|---|---|---|---|---|---|
| 26 | 984 | 924 | 980 | 860 | F1, F2, F3 | 0.35 | 950 | 121 | 155 | 2.55 | 1.69 | Example steel |
| 27 | 985 | 925 | 980 | 860 | F1, F2, F3 | 0.35 | 950 | 121 | 155 | 2.52 | 1.67 | Example steel |
| 28 | 983 | 923 | 980 | 860 | F1, F2, F3 | 0.35 | 950 | 121 | 155 | 2.89 | 1.67 | Example steel |
| 29 | 985 | 925 | 980 | 860 | F1, F2, F3 | 0.35 | 950 | 121 | 155 | 2.57 | 1.67 | Example steel |
| 30 | 985 | 925 | 980 | 860 | F1, F2, F3 | 0.35 | 950 | 122 | 155 | 2.50 | 1.68 | Example steel |
| 31 | 985 | 925 | 980 | 860 | F1, F2, F3 | 0.35 | 950 | 117 | 170 | 2.45 | 1.68 | Example steel |
| 32 | 985 | 925 | 980 | 860 | F1, F2, F3 | 0.35 | 950 | 115 | 195 | 2.50 | 1.65 | Example steel |
| 33 | 990 | 930 | 980 | 860 | F1, F2, F3 | 0.35 | 950 | 115 | 161 | 2.65 | 1.68 | Example steel |
| 34 | 990 | 930 | 980 | 860 | F1, F2, F3 | 0.35 | 950 | 115 | 162 | 2.95 | 1.68 | Example steel |
| 35 | 990 | 930 | 980 | 860 | F1, F2 | 0.35 | 950 | 131 | 161 | 2.85 | 1.68 | Example steel |
| 36 | 990 | 930 | 980 | 860 | F1, F2 | 0.35 | 950 | 119 | 162 | 2.95 | 1.68 | Example steel |
| 37 | 990 | 930 | 980 | 860 | F1, F2 | 0.35 | 950 | 125 | 162 | 2.80 | 1.69 | Example steel |
| 38 | 1000 | 940 | 980 | 860 | F1, F2 | 0.35 | 950 | 115 | 162 | 2.95 | 1.69 | Example steel |
| 39 | 1000 | 940 | 980 | 860 | F1, F2 | 0.35 | 950 | 119 | 163 | 2.92 | 1.68 | Example steel |
| 40 | 990 | 930 | 980 | 860 | F1, F2 | 0.35 | 950 | 112 | 162 | 2.95 | 1.67 | Example steel |
| 41 | 990 | 930 | 980 | 860 | F1, F2 | 0.35 | 950 | 106 | 155 | 2.62 | 1.63 | Comparative steel |
| 42 | 990 | 930 | 980 | 860 | F1, F2 | 0.35 | 950 | 113 | 156 | 3.92 | 1.63 | Comparative steel |
| 43 | 980 | 920 | 980 | 860 | F1, F2 | 0.35 | 950 | 119 | 157 | 3.32 | 1.63 | Comparative steel |
| 44 | 990 | 930 | 980 | 860 | F1, F2 | 0.35 | 950 | 106 | 157 | 4.20 | 1.61 | Comparative steel |
| 45 | 1060 | 1000 | 990 | 870 | F1 | 0.35 | 950 | 104 | 151 | 3.36 | 1.63 | Comparative steel |
| 46 | 1010 | 950 | 1030 | 910 | F3, F4, F5 | 0.35 | 950 | 120 | 152 | 2.80 | 1.71 | Example steel |
| 47 | 1010 | 950 | 1030 | 910 | F3, F4, F5 | 0.35 | 950 | 122 | 152 | 2.71 | 1.72 | Example steel |
| 48 | 1010 | 950 | 1030 | 910 | F3, F4, F5 | 0.35 | 950 | 121 | 152 | 2.55 | 1.71 | Example steel |
| 49 | 1010 | 950 | 1030 | 910 | F3, F4, F5 | 0.35 | 950 | 120 | 152 | 2.80 | 1.72 | Example steel |
| 50 | 1010 | 950 | 1030 | 910 | F3, F4, F5 | 0.35 | 950 | 122 | 152 | 2.56 | 1.73 | Example steel |
| 51 | 1010 | 950 | 1030 | 910 | F3, F4, F5 | 0.35 | 950 | 120 | 152 | 2.50 | 1.73 | Example steel |

From Tables 3-1 and 3-2, it can be seen that all of the non-oriented electrical steel sheets according to our examples in which the chemical composition, the $Ar_a$ transformation temperature, the grain size, and the Vickers hardness are within the scope of the disclosure have both excellent magnetic flux density and iron loss properties as compared with the steel sheets in the comparative examples outside the scope of the disclosure.

INDUSTRIAL APPLICABILITY

According to the disclosure, it is possible to provide non-oriented electrical steel sheets achieving a good balance between the magnetic flux density and iron loss properties without performing hot band annealing.

REFERENCE SIGNS LIST

1 Ring sample
2 V caulking

The invention claimed is:

1. A non-oriented electrical steel sheet comprising a chemical composition consisting of, by mass %,
C: 0.0050% or less,
Si: 2.01% or more and 4.00% or less,
Al: 0.002% or less,
Mn: 0.10% or more and 5.00% or less,
S: 0.0200% or less,
P: 0.200% or less,
N: 0.0050% or less,
O: 0.0200% or less, and
at least one of Sb: 0.0010% or more and 0.10% or less or Sn: 0.0010% or more and 0.10 or less, and
optionally at least one selected from the group consisting of
Ca: 0.0010% or more and 0.0050% or less,
Ni: 0.010% or more and 3.0% or less,
Ti: 0.0030% or less,
Nb: 0.0030% or less,
V: 0.0030% or less, and
Zr: 0.0020% or less,
with the balance being Fe and inevitable impurities, wherein
the non-oriented electrical steel sheet has an $Ar_3$ transformation temperature of 700° C. or higher and 940° C. or lower, a grain size of 80 μm or more and 200 μm or less, and a Vickers hardness of 140 HV or more and 230 HV or less.

2. The non-oriented electrical steel sheet according to claim 1, wherein Ca, by mass %: 0.0010% or more and 0.0050% or less.

3. The non-oriented electrical steel sheet according to claim 1, wherein Ni, by mass %: 0.010% or more and 3.0% or less.

4. The non-oriented electrical steel sheet according to claim 1, wherein at least one selected from the group consisting of, by mass %
Ti: 0.0030% or less,
Nb: 0.0030% or less,
V: 0.0030% or less, and
Zr: 0.0020% or less.

5. A method of producing the non-oriented electrical steel sheet as recited in claim 1, the method comprising performing hot rolling in at least one pass in a dual phase region from γ-phase to α-phase, thereby producing the non-oriented electrical steel sheet of claim 1.

6. The non-oriented electrical steel sheet according to claim 2, wherein Ni, by mass %: 0.010% or more and 3.0% or less.

7. The non-oriented electrical steel sheet according to claim 2, wherein at least one selected from the group consisting of, by mass %

Ti: 0.0030% or less,

Nb: 0.0030% or less,

V: 0.0030% or less, and

Zr: 0.0020% or less.

8. The non-oriented electrical steel sheet according to claim 3, wherein at least one selected from the group consisting of, by mass %

Ti: 0.0030% or less,

Nb: 0.0030% or less,

V: 0.0030% or less, and

Zr: 0.0020% or less.

9. The non-oriented electrical steel sheet according to claim 6, wherein at least one selected from the group consisting of, by mass %

Ti: 0.0030% or less,

Nb: 0.0030% or less,

V: 0.0030% or less, and

Zr: 0.0020% or less.

10. A method of producing the non-oriented electrical steel sheet as recited in claim 2, the method comprising performing hot rolling in at least one pass in a dual phase region from γ-phase to α-phase, thereby producing the non-oriented electrical steel sheet of claim 2.

11. A method of producing the non-oriented electrical steel sheet as recited in claim 3, the method comprising performing hot rolling in at least one pass in a dual phase region from γ-phase to α-phase, thereby producing the non-oriented electrical steel sheet of claim 3.

12. A method of producing the non-oriented electrical steel sheet as recited in claim 4, the method comprising performing hot rolling in at least one pass in a dual phase region from γ-phase to α-phase, thereby producing the non-oriented electrical steel sheet of claim 4.

13. A method of producing the non-oriented electrical steel sheet as recited in claim 6, the method comprising performing hot rolling in at least one pass in a dual phase region from γ-phase to α-phase, thereby producing the non-oriented electrical steel sheet of claim 6.

14. A method of producing the non-oriented electrical steel sheet as recited in claim 7, the method comprising performing hot rolling in at least one pass in a dual phase region from γ-phase to α-phase, thereby producing the non-oriented electrical steel sheet of claim 7.

15. A method of producing the non-oriented electrical steel sheet as recited in claim 8, the method comprising performing hot rolling in at least one pass in a dual phase region from γ-phase to α-phase, thereby producing the non-oriented electrical steel sheet of claim 8.

16. A method of producing the non-oriented electrical steel sheet as recited in claim 9, the method comprising performing hot rolling in at least one pass in a dual phase region from γ-phase to α-phase, thereby producing the non-oriented electrical steel sheet of claim 9.

* * * * *